US007207074B1

(12) United States Patent
Stewart

(10) Patent No.: US 7,207,074 B1
(45) Date of Patent: Apr. 24, 2007

(54) DISH DRYING RACK SYSTEM

(76) Inventor: Kim C. Stewart, 7175 McColl Dr., Niagara Falls, Ontario (CA) L2J 1G7

( * ) Notice: Subject to any disclaimer, the term of this patent is extended or adjusted under 35 U.S.C. 154(b) by 327 days.

(21) Appl. No.: 11/032,600

(22) Filed: Jan. 11, 2005

(51) Int. Cl.
*A47B 77/06* (2006.01)

(52) U.S. Cl. ..... 4/637; 4/656; 211/41.3; 220/572; 312/228.1

(58) Field of Classification Search ..... 4/630, 4/637, 638, 656; 211/41.3; 220/572; 312/228.1
See application file for complete search history.

(56) References Cited

U.S. PATENT DOCUMENTS

| | | | | |
|---|---|---|---|---|
| 477,758 | A | 6/1892 | Huss | |
| 1,026,537 | A * | 5/1912 | Weaver | 4/638 |
| 1,046,604 | A | 12/1912 | Kansit | |
| 1,835,232 | A * | 12/1931 | Lord | 211/85 |
| 2,473,862 | A * | 6/1949 | Clawsey | 312/228 |
| 2,538,233 | A | 1/1951 | Brandstrom | |
| D347,717 | S | 6/1994 | Chapin | |
| D421,490 | S | 3/2000 | Talerico | |
| 6,516,956 | B2 | 2/2003 | Martorella et al. | |

* cited by examiner

*Primary Examiner*—Charles E. Phillips

(57) ABSTRACT

A dish drying rack system includes a sink and drain basin extending through a peripheral wall of the sink. A drain panel is positioned over the drain basin. The drain panel has a plurality of holes extending therethrough. Each of plurality of legs is attached to and extends downwardly from a loop member. The legs are positioned on the loop member so that each of the legs extends through one of the holes. A locking assembly is adapted for releasably locking each of the free ends in a position adjacent to a bottom surface of the drain panel so that the legs extend upwardly from the drain panel. A plurality of rods is attached to and traverses the loop member. Plates are selectively positioned within the loop member and vertically supported thereby when each of the free ends is in a locked position.

16 Claims, 6 Drawing Sheets

DISH DRYING RACK SYSTEM

BACKGROUND OF THE INVENTION

1. Field of the Invention

The present invention relates to drying rack devices and more particularly pertains to a new drying rack device that can be collapsed for easy storage.

2. Description of the Prior Art

The use of drying rack devices is known in the prior art. U.S. Pat. No. 2,473,862 describes a device that combines a dining table and sink. Within the sink is found a rack for holding dishes to be dried. Another type of drying rack device is U.S. Pat. No. 2,538,233 that is mountable to a wall and can be extended downwardly for receiving dishes. This allows a person to dry the dishes over a sink. Yet another such drying device is U.S. Pat. No. 6,516,956 that includes both a catch basin and a vertical support for dishes.

While these devices fulfill their respective, particular objectives and requirements, the need remains for a device that can hold dishes in a vertical orientation so that they can properly dry, but that includes the ability to collapse so that it can be laid flat against a sink or drying basin bottom, or stored in a more compact manner. This would preferably be done by including a modified sink in which a drying rack is mounted for easy retrieval or storage. This would increase the aesthetics of the device, which is typically very unattractive, and will also allow a person to store the drying device underneath the sink.

SUMMARY OF THE INVENTION

The present invention meets the needs presented above by generally comprising a sink that includes a bottom wall and a peripheral wall that is attached to and extends upwardly from the bottom wall. A drain basin extends through the peripheral wall. The drain basin has a depth less than the sink so that fluid poured into the drain basin flows into the sink. A drain panel is positioned over and covers the drain basin. The drain panel has a plurality of holes extending therethrough. A loop member is provided. Each of plurality of legs is attached to and extends downwardly from the loop member. Each of the legs has a free end. The legs are positioned on the loop member such that each of the legs extends through one of the holes and each of the free ends is positioned between a bottom wall of the drain basin and the drain panel. A locking assembly is adapted for releasably locking each of the free ends in a position adjacent to a bottom surface of the drain panel so that the legs extend upwardly from the drain panel. A plurality of rods is attached to and traverses the loop member. Plates are selectively positioned within the loop member and vertically supported thereby when each of the free ends is in a locked position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
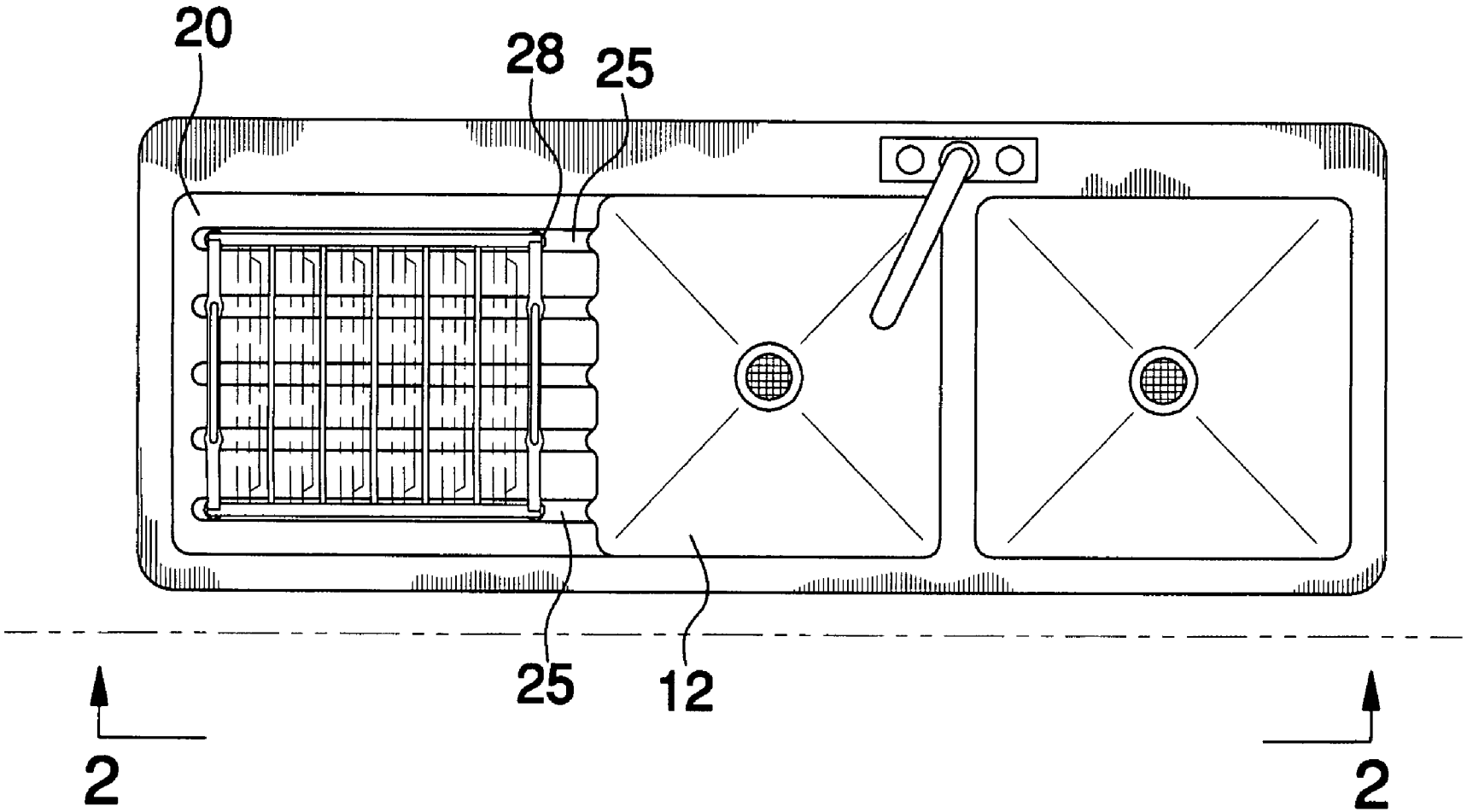
FIG. 1 is a top view of a dish drying rack system according to the present invention.
Figure 2:
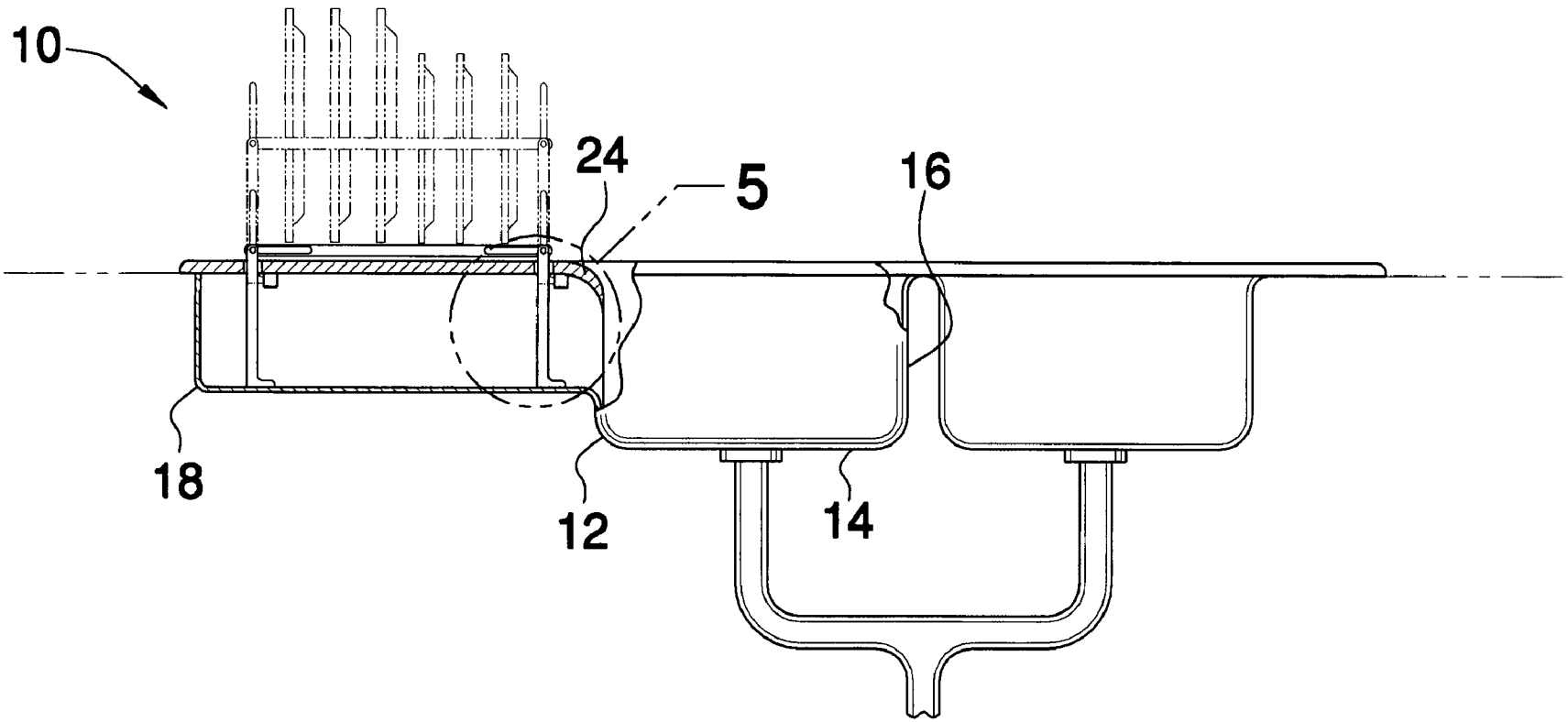
FIG. 2 is a broken side view of the present invention.
Figure 3:
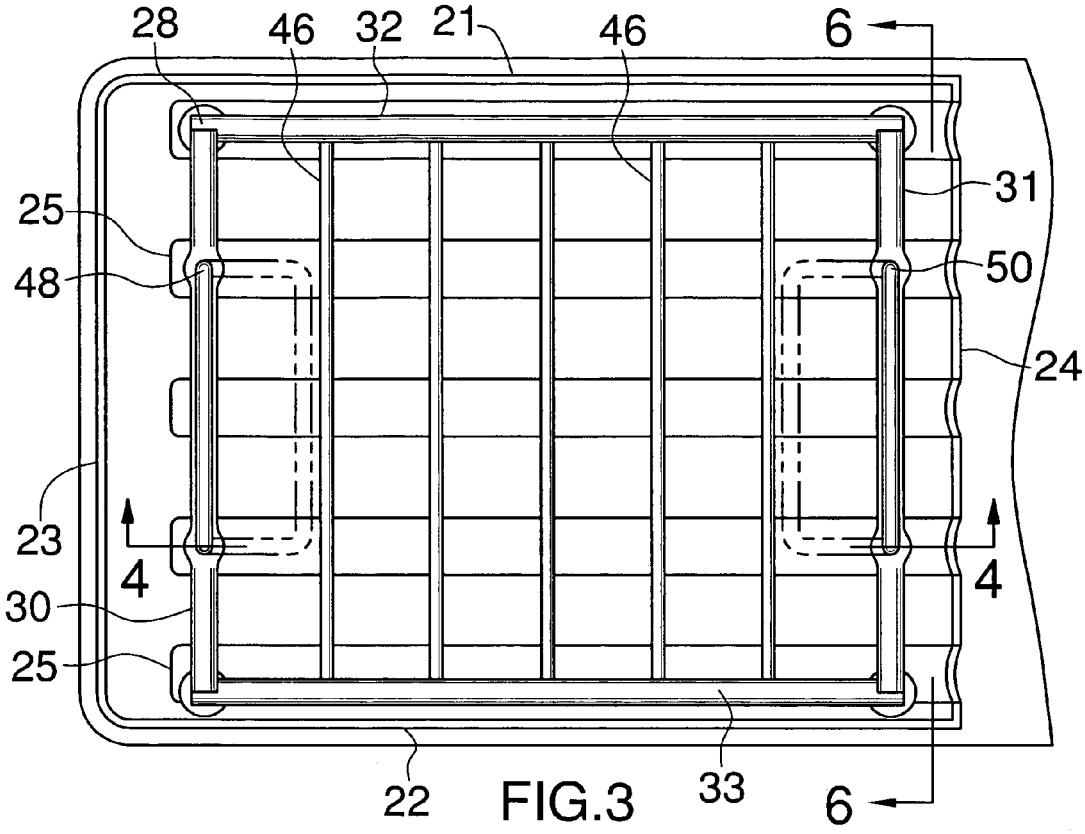
FIG. 3 is a top view of the present invention.
Figure 4:
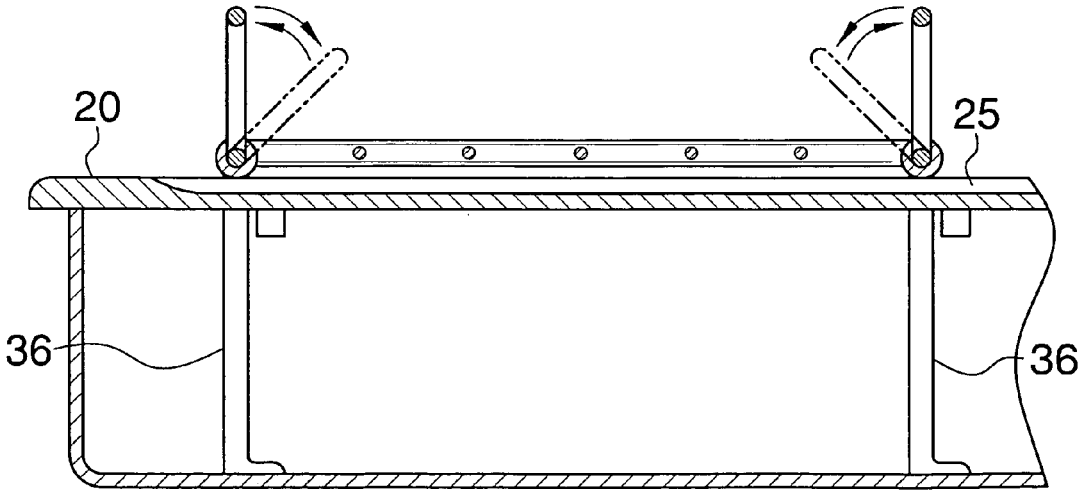
FIG. 4 is a cross-sectional view taken along line 4—4 of FIG. 3 of the present invention.
Figure 5:
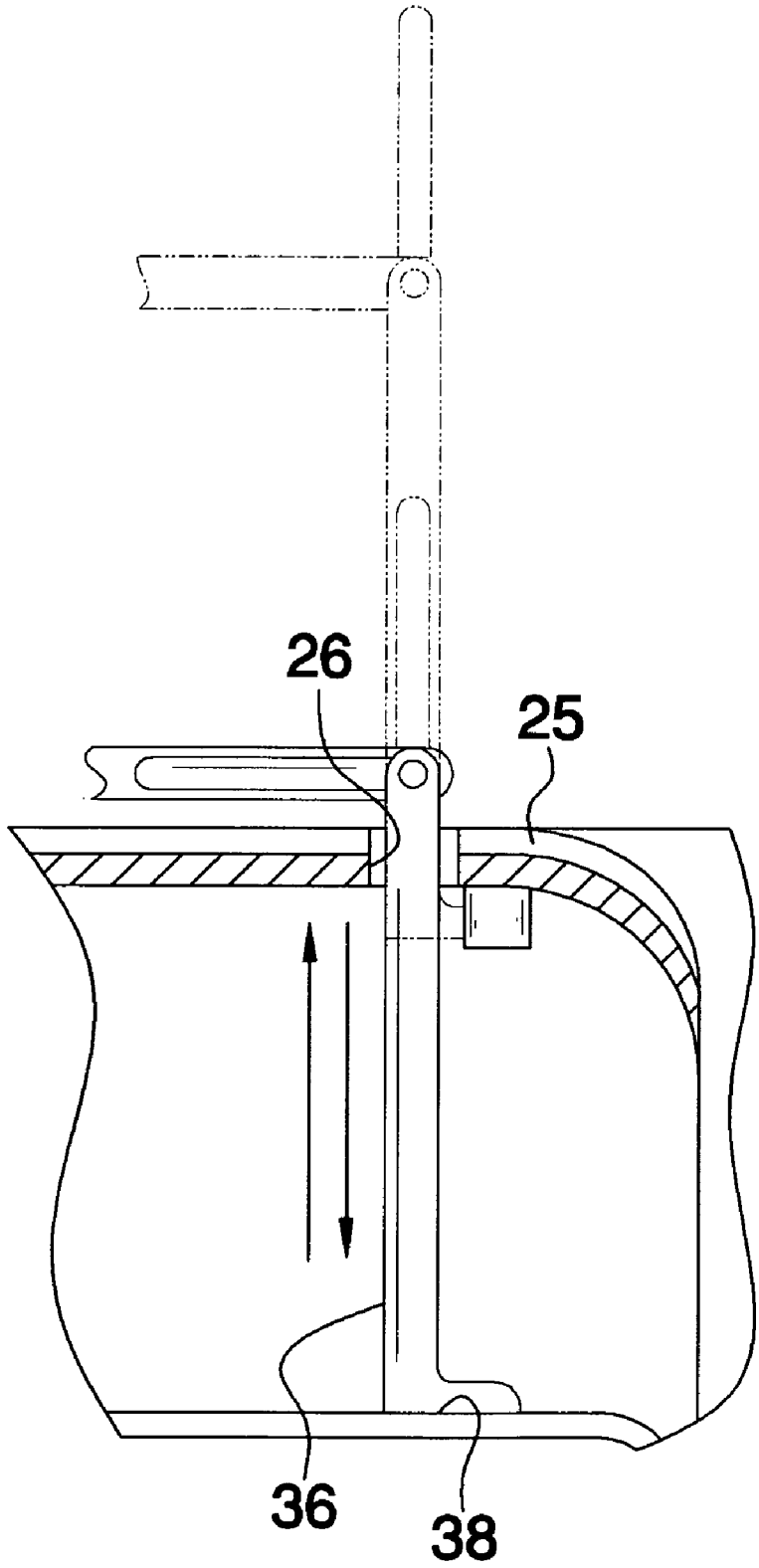
FIG. 5 is an enlarged view of section 5 of FIG. 2 of the present invention.
Figure 6:
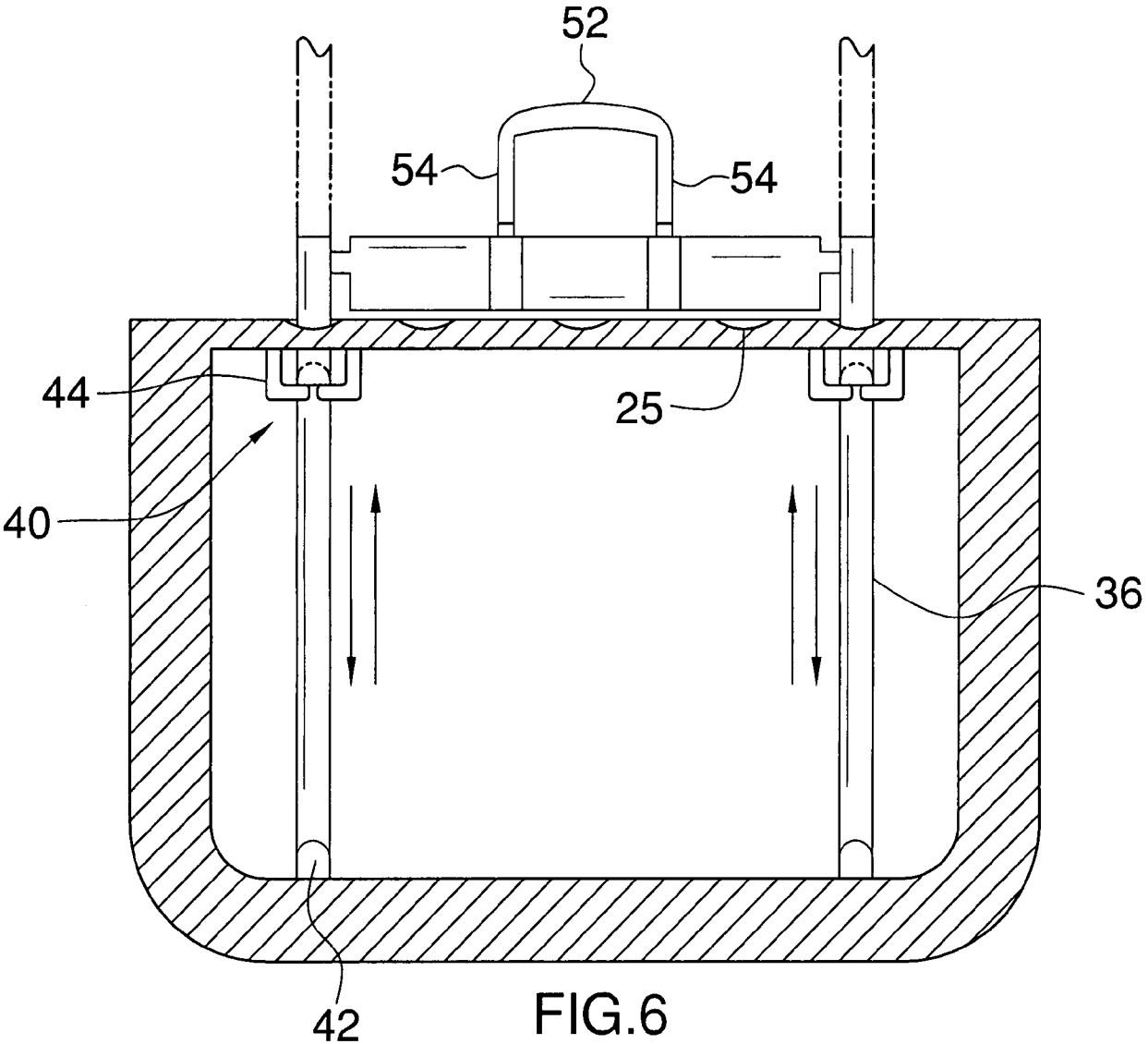
FIG. 6 is a cross-sectional view taken along line 6—6 of FIG. 3 of the present invention.

With reference now to the drawings, and in particular to FIGS. 1 through 7 thereof, a new drying rack device embodying the principles and concepts of the present invention and generally designated by the reference numeral 10 will be described.

As best illustrated in FIGS. 1 through 7, the dish drying rack system 10 generally comprises a sink 12 that has a bottom wall 14 and a peripheral wall 16, which is attached to and extends upwardly from the bottom wall 14. A drain basin 18 extends through the peripheral wall 16. The drain basin 18 has a depth less than the sink 12 so that fluid poured into the drain basin 18 flows into the sink 12. A drain panel 20 is positioned over and covers the drain basin 18. The drain panel 20 may be integrally coupled to an upper edge of the drain basin 18. The drain panel 20 has a first lateral edge 21, a second lateral edge 22, a distal edge 23 and proximal edge 24 with respect to the sink 12. The drain panel 20 has a plurality of grooves 25 therein extending from a point adjacent to the distal edge 23 and through the proximal edge 24. The proximal edge 24 curves downwardly toward the sink 12. The drain panel 20 has a plurality of holes 26 extending therethrough. A first pair of the holes 26 is spaced from each other and is positioned adjacent to the first lateral edge 21. A second pair of the holes 26 is spaced from each other and is positioned adjacent to the second lateral edge 22. Each of the holes 26 is preferably positioned in one of the grooves 25.

A generally rectangular loop member 28 includes a first lateral member 30, a second lateral member 31, a first end member 32 and a second lateral member 33. The first 30 and second 31 end members are selectively rotatably about their longitudinal axis with respect to the first 32 and second 33 lateral members.

Each of a plurality of legs 36 is attached to and extends downwardly from the loop member 28. Each of the legs 36 has a free end 38. The legs 38 are positioned on the loop member 28 so that each of the legs 36 extends through one of the holes 26 and each of the free ends 38 is positioned between a bottom wall of the drain basin 18 and the drain panel 20. The legs 36 are attached to one of the first 32 and second 33 lateral members. Each of the legs 36 has a height generally equal to a height of from the drain panel 20 to the bottom wall of the drain basin 18.

A locking assembly 40 is adapted for releasably locking each of the free ends 38 in a position adjacent to a bottom surface of the drain panel 20 so that the legs 36 extend upwardly from the drain panel 20. The locking assembly 40 includes a plurality of a plurality of feet 42. Each of the feet 42 is attached to one of the free ends 38. The feet 42 each include a protruding portion. Each of a plurality of foot engaging members 44 is attached to the bottom surface of the drain panel 20. Each of the engaging members 44 is adapted for receiving and snappily retaining one of the protruding portions. This may be accomplished with a U-shaped bracket having a break therein for receiving the protruding portions. The brackets are comprised of resiliently flexible material. The engaging members 44 are positioned for receiving one of the feet 42 when the free ends 38 are positioned adjacent to the bottom surface of the drain panel 20.

Each of a plurality of rods 46 is attached to and extends between the lateral members 32, 33. The rods 46 are orientated parallel to each other and are generally equally spaced from each other.

A first handle 48 and a second handle 50 are attached to the loop member 28. Each of the first 48 and second 50 handles includes a central portion 52 and pair of vertical members 54 that are attached to and extend downwardly from an associated one of the central portions 52. Each of the vertical members 54 of the first handle 48 is attached to the first end member 30. Each of the vertical members 54 of the second handle 50 is attached to the second end member 31. The first 48 and second 50 handles may be selectively positionable in a vertical orientation or a horizontal orientation by rotating the first 30 and second 31 end members.

In use, the sink 12 is used as a conventional sink. When dishes are to be dried, the loop member 28 is lifted with the handles 48,50 to lock the feet 42 in place when the free ends 38 are adjacent to the drain panel 20. Dishes are then vertically supported between rods 46. When dried, the loop member 28 may be lowered down to the drain panel 20 so that the loop member 28 is not readily visible.

Figure 7:
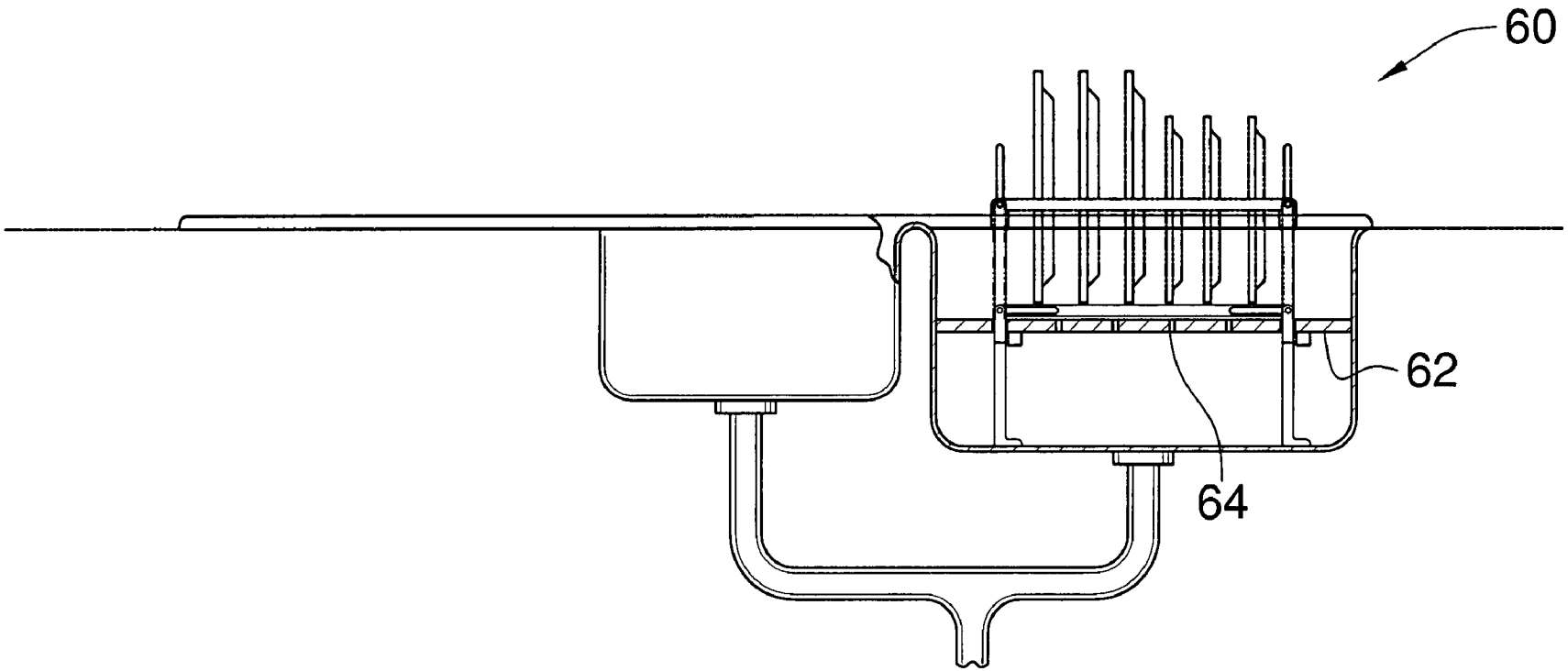
FIG. 7 is a side view of a second embodiment of the present invention.

A second embodiment 60 is shown in FIG. 7 and includes a dividing wall 62 instead of a drain panel 20. The dividing wall 62 includes a plurality of apertures 64 therein for allowing water to pass therethrough. The dividing wall 62 is preferably held in place with friction so that it may be easily removed for cleaning below the dividing wall 62.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible dish drying system comprising:

a sink having a bottom wall and a peripheral wall being attached to and extending upwardly from said bottom wall, a drain basin extending through said peripheral wall, said drain basin having a depth less than said sink such that fluid poured into said drain basin flows into said sink, a drain panel being positioned over and covering said drain basin, said drain panel having a plurality of holes extending therethrough;

a loop member;

a plurality of legs being attached to and extending downwardly from said loop member, each of said legs having a free end, each of said legs being positioned on said loop member such that each of said legs extends through one of said holes and each of said free ends is positioned between a bottom wall of said drain basin and said drain panel;

a locking assembly adapted for releasably locking each of said free ends in a position adjacent to a bottom surface of said drain panel such that said legs extend upwardly from said drain panel;

a plurality of rods being attached to and traversing said loop member; and wherein plates may be selectively positioned within said loop member and vertically supported thereby when each of said free ends is in a locked position.

2. The system according to claim 1, wherein said drain panel has a first lateral edge, a second lateral edge, a distal edge and proximal edge with respect to said sink, said drain panel having a plurality of grooves therein extending from a point adjacent to said distal edge and through said proximal edge.

3. The system according to claim 2, wherein said proximal edge curves downwardly toward said sink.

4. The system according to claim 3, wherein a first pair of said holes is spaced from each other and each is positioned adjacent to said first lateral edge, and a second pair of said holes being spaced from each other and each being positioned adjacent to said second lateral edge.

5. The system according to claim 4, wherein each of said holes being positioned in one of said grooves.

6. The system according to claim 1, further including a first handle and a second handle each being attached to said loop member.

7. The system according to claim 6, wherein said loop member is generally rectangular and includes a first lateral member, a second lateral member, a first end member and a second lateral member, said first and second end members each being selectively rotatably about their longitudinal axis with respect to said first and second lateral members, each of said first and second handles being attached to one of said first and second end members.

8. The system according to claim 7, wherein each of said first and second handles including a central portion and pair of vertical members being attached to and extending downwardly from an associated one of said central portions, each of said vertical members of said first handle being attached to said first end member, each of said vertical members of said second handle being attached to said second end member, said first and second handles may being selectively positionable in a vertical orientation or a horizontal orientation.

9. The system according to claim 1, wherein each of said legs has a height generally equal to a height of from said drain panel to said bottom wall of said drain basin.

10. The system according to claim 6, wherein said locking assembly includes:

a plurality of a plurality of feet, each of said feet being attached to one of said free ends, each of said feet including a protruding portion; and a plurality of foot engaging members, each of said foot engaging members being attached to said bottom surface of said drain panel, each of said engaging members being adapted for receiving and snappily retaining one of said protruding portions, each of said engaging members being positioned for receiving one of said feet when said free ends are positioned adjacent to said bottom surface of said drain panel.

11. A collapsible dish drying system comprising:

a sink having a bottom wall and a peripheral wall being attached to and extending upwardly from said bottom wall, a drain basin extending through said peripheral wall, said drain basin having a depth less than said sink such that fluid poured into said drain basin flows into said sink, a drain panel being positioned over and covering said drain basin, said drain panel having a first lateral edge, a second lateral edge, a distal edge and proximal edge with respect to said sink, said drain panel having a plurality of grooves therein extending from a point adjacent to said distal edge and through said proximal edge, said proximal edge curving downwardly toward said sink, said drain panel having a plurality of holes extending therethrough, a first pair of said holes being spaced from each other and being positioned adjacent to said first lateral edge, a second pair of said holes being spaced from each other and being positioned adjacent to said second lateral edge, each of said holes being positioned in one of said grooves;

a generally rectangular loop member including a first lateral member, a second lateral member, a first end member and a second lateral member, said first and second end members being selectively rotatably about their longitudinal axis with respect to said first and second lateral members;

a plurality of legs being attached to and extending downwardly from said loop member, each of said legs having a free end, each of said legs being positioned on said loop member such that each of said legs extends through one of said holes and each of said free ends is positioned between a bottom wall of said drain basin and said drain panel, each of said legs being attached to one of said first and second lateral members, each of said legs having a height generally equal to a height of from said drain panel to said bottom wall of said drain basin;

a locking assembly adapted for releasably locking each of said free ends in a position adjacent to a bottom surface of said drain panel such that said legs extend upwardly from said drain panel, said locking assembly including;

a plurality of a plurality of feet, each of said feet being attached to one of said free ends, each of said feet including a protruding portion;

a plurality of foot engaging members, each of said foot engaging members being attached to said bottom surface of said drain panel, each of said engaging members being adapted for receiving and snappily retaining one of said protruding portions, each of said engaging members being positioned for receiving one of said feet when said free ends are positioned adjacent to said bottom surface of said drain panel;

a plurality of rods, each of said rods being attached to and extending between said lateral members, said rods being orientated parallel to each other, said rods being generally equally spaced from each other;

a first handle and a second handle, each of said first and second handles including a central portion and pair of vertical members being attached to and extending downwardly from an associated one of said central portions, each of said vertical members of said first handle being attached to said first end member, each of said vertical members of said second handle being attached to said second end member, said first and second handles may being selectively positionable in a vertical orientation or a horizontal orientation; and wherein plates may be selectively positioned within said loop member and vertically supported thereby when each of said free ends is in a locked position.

12. A collapsible dish drying system comprising:

a sink having a bottom wall and a peripheral wall being attached to and extending upwardly from said bottom wall, a dividing wall being horizontally mounted in said sink and being spaced from said bottom wall, said dividing wall having a plurality of apertures extending therethrough, said dividing wall having a plurality of holes extending therethrough;

a loop member;

a plurality of legs being attached to and extending downwardly from said loop member, each of said legs having a free end, each of said legs being positioned on said loop member such that each of said legs extends through one of said holes and each of said free ends is positioned between a bottom wall of said sink and said dividing wall;

a locking assembly adapted for releasably locking each of said free ends in a position adjacent to a bottom surface of said dividing wall such that said legs extend upwardly from said dividing wall;

a plurality of rods, each of said rods being attached to and traversing said loop member; and wherein plates may be selectively positioned within said loop member and vertically supported thereby when each of said free ends is in a locked position.

13. The system according to claim 12, further including a first handle and a second handle each being attached to said loop member.

14. The system according to claim 13, wherein said loop member is generally rectangular and includes a first lateral member, a second lateral member, a first end member and a second lateral member, said first and second end members being selectively rotatably about their longitudinal axis with respect to said first and second lateral members, each of said first and second handles including a central portion and pair of vertical members being attached to and extending downwardly from an associated one of said central portions, each of said vertical members of said first handle being attached to said first end member, each of said vertical members of said second handle being attached to said second end member, said first and second handles may being selectively positionable in a vertical orientation or a horizontal orientation.

15. The system according to claim 12, wherein said locking assembly includes:

a plurality of a plurality of feet, each of said feet being attached to one of said free ends, each of said feet including a protruding portion; and a plurality of foot engaging members, each of said foot engaging members being attached to said bottom surface of said dividing wall, each of said engaging members being adapted for receiving and snappily retaining one of said protruding portions, each of said engaging members being positioned for receiving one of said feet when said free ends are positioned adjacent to said bottom surface of said dividing wall.

16. The system according to claim 14, wherein said locking assembly includes:

a plurality of a plurality of feet, each of said feet being attached to one of said free ends, each of said feet including a protruding portion; and a plurality of foot engaging members, each of said foot engaging members being attached to said bottom surface of said dividing wall, each of said engaging members being adapted for receiving and snappily retaining one of said protruding portions, each of said engaging members being positioned for receiving one of said feet when said free ends are positioned adjacent to said bottom surface of said dividing wall.

* * * * *